United States Patent [19]

Osepchuk

[11] 4,223,246

[45] Sep. 16, 1980

[54] MICROWAVE TUBES INCORPORATING RARE EARTH MAGNETS

[75] Inventor: John M. Osepchuk, Concord, Mass.

[73] Assignee: Raytheon Company, Lexington, Mass.

[21] Appl. No.: 3,052

[22] Filed: Jan. 12, 1979

Related U.S. Application Data

[63] Continuation of Ser. No. 812,100, Jul. 1, 1977, abandoned.

[51] Int. Cl.[2] ..... H01J 25/50

[52] U.S. Cl. ..... 315/39.71; 313/38; 313/46; 315/39.51; 315/5.35

[58] Field of Search ..... 315/39.71, 5.35, 3.5, 315/39.51; 313/38, 46

[56] References Cited

U.S. PATENT DOCUMENTS

| | | | |
|---|---|---|---|
| 3,989,979 | 11/1976 | Konno et al. | 315/39.71 |
| 4,048,542 | 9/1977 | Miura | 315/39.51 |
| 4,071,804 | 1/1978 | Koinuma et al. | 315/39.51 |

*Primary Examiner*—Saxfield Chatmon, Jr.

*Attorney, Agent, or Firm*—M. D. Bartlett; J. D. Pannone; H. W. Arnold

[57] ABSTRACT

A microwave tube having a heated cathode with a rare earth magnet positioned inside the evacuated envelope of the tube and at least partially shielded from thermal radiation from the cathode and/or anode so that the magnet may be operated at elevated temperatures while protected from environment such as oxygen in the air to prevent degradation of the magnetic properties of the magnet at temperatures up to 500° C. during processing of the tube or up to 250° C. during operation of the tube with thermal shielding from the hot cathode preventing any surface of the magnet from exceeding such temperatures.

5 Claims, 5 Drawing Figures

MICROWAVE TUBES INCORPORATING RARE EARTH MAGNETS

CROSS-REFERENCE TO RELATED CASES

This is a continuation of application Ser. No. 812,100, filed July 1, 1977, now abandoned.

CROSS-REFERENCE TO RELATED APPLICATIONS

Application Ser. No. 751,288 filed Dec. 16, 1976, by John M. Osepchuk and application Ser. No. 416,700 filed Nov. 16, 1973, by Dilip K. Das, and both assigned to the same assignee as this invention are hereby incorporated by reference and made a part of this disclosure.

BACKGROUND OF THE INVENTION

A rare earth magnet such as samarium cobalt or cerium cobalt has been used as magnets for microwave tubes, for example as shown in U.S. Pat. No. 3,781,592. However, such devices have generally been positioned sufficiently far from sources of heat in the microwave tubes so that a relatively low temperature such as 125° C. was not exceeded. As a result, additional weight of material for the pole piece and an additional amount of permanent magnet material was generally required. When rare earth permanent magnet material was used over an extended period of time in air even at temperatures somewhat below 125° C., the magnet properties of the rare earth magnet were altered generally reducing the energy product and changing the operating characteristics of devices such as microwave tubes.

SUMMARY OF THE INVENTION

In accordance with this invention, there is disclosed the discovery that rare earth magnets can be operated at substantially higher temperatures in a protected environment such as a vacuum or inert gas for extended periods of time without permanent alteration of the magnetic properties. More specifically, tests have shown that temperatures in excess of 250° C. may be used for extended periods of time without any substantial permanent change of the magnet material.

In accordance with this invention, a variety of applications of rare earth permanent magnets to microwave tubes may utilize the magnet material directly in the desired region without additional pole pieces for field concentration and/or magnetic flux return paths. Such benefits are achieved by reason of the high energy product of the rare earth magnet material and the fact that such energy product is not permanently altered by RF fields in devices such as magnetrons, amplitrons, or travelling wave tubes using heated cathodes having a transverse magnetic field of a few thousand gauss produced by the rare earth permanent magnet system.

In one embodiment of the invention, a travelling wave tube of the O-type has a beam directed down an interaction path produced, for example, by slow wave structure such as a helix while providing permanent magnets in regions outside the helix to supply magnet bias for ferrite material oriented to present a minimal insertion loss to signals travelling on the helix in the same direction as the electron beam and a substantially greater insertion loss to signals travelling on the helix in a direction opposite to the beam, to prevent oscillation of the tube when used as an amplifier due to reflections from the impedance mismatches at the output of the helix and/or at the input of the helix. The close proximity of rare earth magnets to the slow wave structure which is being heated by impingement of stray electrons from the beam is possible without the temperature of the magnet material exceeding temperatures such as 250° C.

In addition, this invention further discloses that the magnet material may be cooled by thermal conduction through the support structure to an outside surface structure of the tube so that thermal energy radiated to the rare earth magnet material by hot portions of the tube such as the cathode or anode is conducted away at a rate causing thermal equilibrium of the magnet material at a temperature below its long-term degradation temperature.

This invention further discloses that the permanent magnet material may be encapsulated in a thin layer of conductive, substantially thermal, radiation reflective material such as copper which further prevents heat of the magnet material, such conductive layer being in general insufficient in thickness to provide the wall between an evacuated area and atmospheric pressure between being of sufficient thickness to conduct heat away from the region which may be generated due to impingement of stray electrons thereon or to thermal radiation.

BRIEF DESCRIPTION OF THE DRAWINGS

Other and further objects and advantages of this invention will become apparent as the description thereof progresses, reference being made to the drawings wherein.

DESCRIPTION OF THE PREFERRED EMBODIMENT

Figure 1:
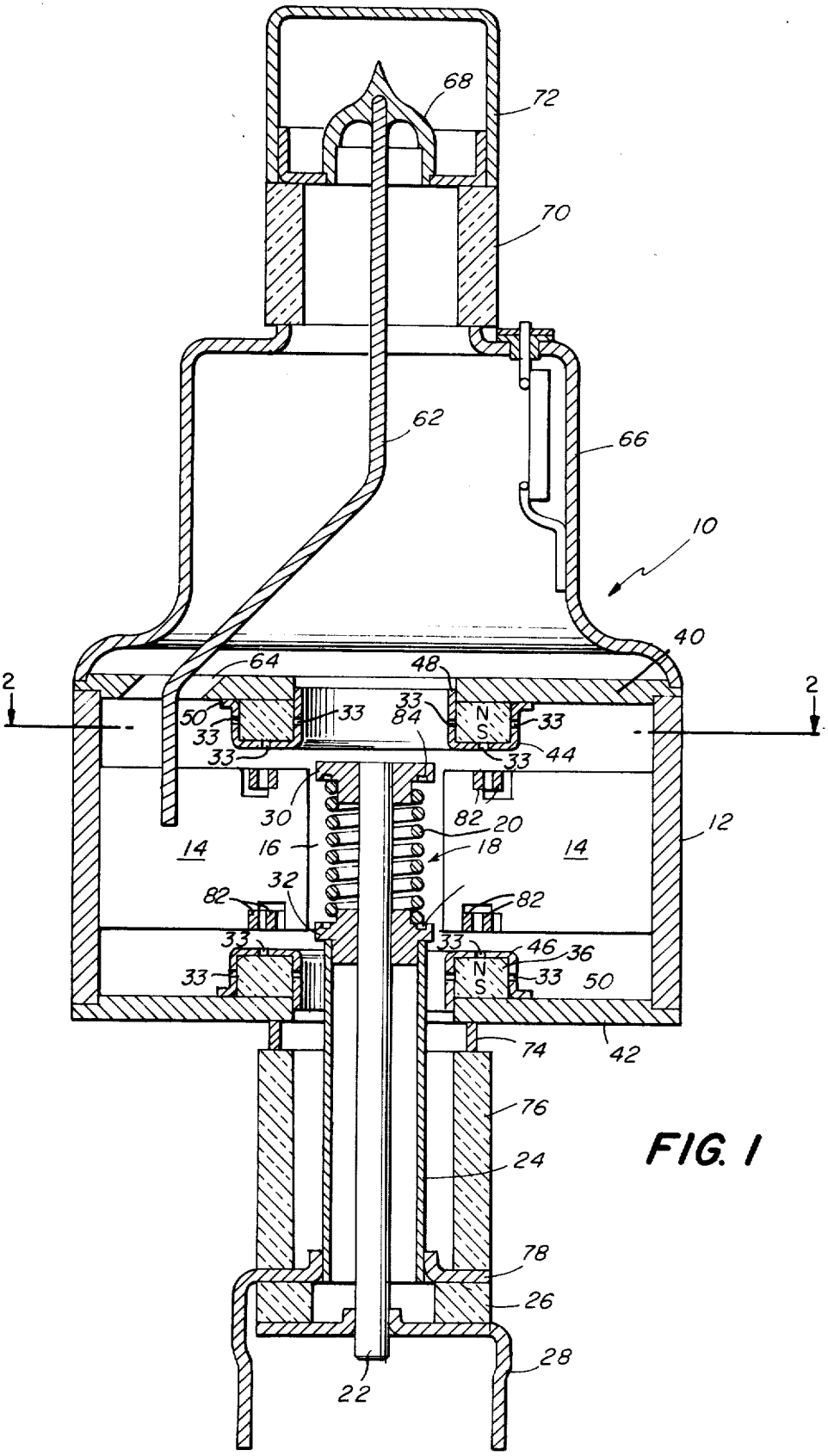
FIG. 1 illustrates a longitudinal sectional view, taken along line 1—1 of FIG. 2 and of a magnetron embodying the invention.
Figure 2:
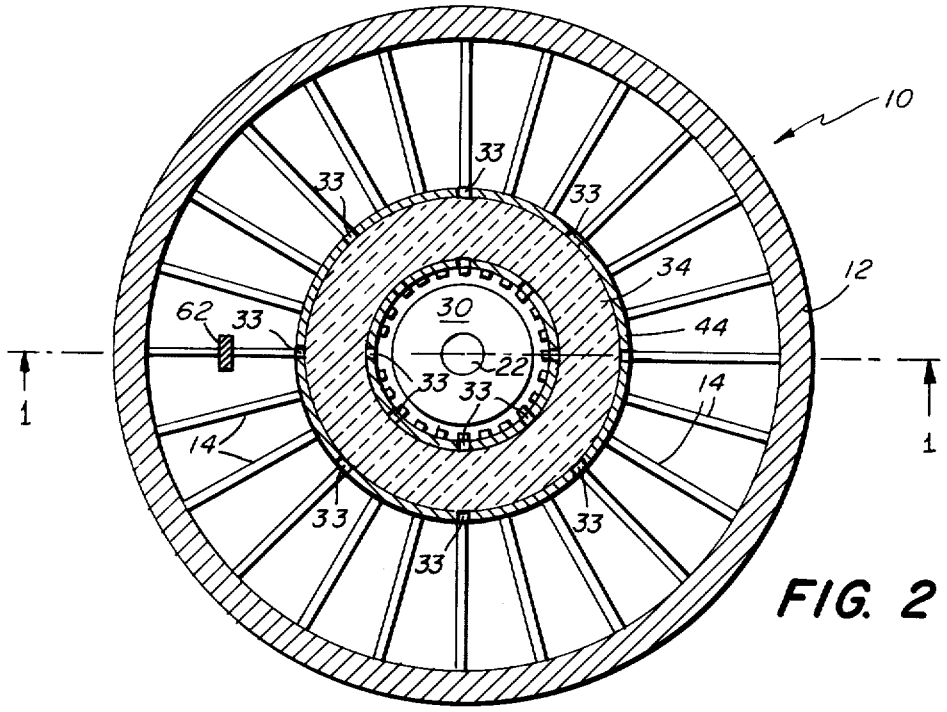
FIG. 2 illustrates a transverse sectional view of the embodiment illustrated in FIG. 1 taken along line 2—2 of FIG. 1.

Referring now to FIGS. 1 and 2, there is shown a magnetron 10 comprising an anode cylinder 12 made, for example, of a material having high permeability such as steel coated with copper. A plurality of anode members 14 extend radially inwardly from cylinder 12 to a central bore 16 containing a cathode 18 of the directly heated type utilizing a carbonized tungsten filament 20, which is helically coiled and is attached at its upper end to a central support rod 22.

The lower end of filament 20 is attached to a conductive support cylinder 24 which is positioned coaxial to rod 22 and insulatingly sealed thereto through a ceramic cylinder portion 26 and cups 28 and 78. Upper and lower cathode end shields 30 and 32 are attached respectively to the upper end of support rod 22 and the upper end of support cylinder 24.

In accordance with this invention, upper and lower annular rare earth permanent magnet members 34 and 36, such as $SmCo_5$, are positioned coaxial with cathode 18 and respectively above and below end shields 30 and 32.

As shown herein, by way of example only, permanent magnet members 34 and 36, which preferably are both poled in the same direction axially to cathode 18 to produce a magnetic field, are positioned substantially coaxial with the cathode 18 and extend radially from a point inside the diameter of filament 20 to a point outside the diameter of bore 16.

In accordance with this invention, magnets 34 and 36 are positioned as close as practicable to the interaction space between the inner ends of anode members 14 and the filament 20 in order that the amount of magnet material required to produce the desired magnetic field density is minimized.

In accordance with this invention, it is disclosed that rare earth magnets in an inert environment such as a vacuum can withstand high temperatures while maintaining stable magnetic characteristics. For example, temperatures in the range between 150° C. and 250° C. during continuous operation as well as higher temperatures up to 500° C. during short periods of hours to days can be achieved. The magnetron, as illustrated herein, may be used, for example, in a microwave oven operating with a voltage between the filament 20 and the anode members 14 of around 4,000 volts. At an average current of around 300 mils will result in heating of the tips of the anode members 14 to several hundred degrees. In addition, filament 20 is preferably heated to temperatures in the range of 1,400° C. to 1,700° C. Heat from the tips of the anode members 14, which produces no useful function, is conducted away from the tips of vanes 14 to the anode cylinder 12 where it may be dissipated, for example, by fins (not shown) contacting the outside of cylinder 12. However, thermal radiation from inner ends of anode members 14 as well as thermal radiation from filament 20, which may be reflected by the shiny copper surfaces of anode members 14 and cylinder 12, can be radiated toward magnets 34 and 36. In addition, some stray electrons, which can escape from the interaction region of bore 16 between the end shields 30 and 32 may move toward the magnets 34 and 36. Therefore, thermal energy absorbed by the magnets 34 and 36 is preferably dissipated to prevent such magnets from exceeding temperatures during operation of, for example, 150° C. to 250° C.

Upper and lower cups 44 and 46 of material having high thermal reflectivity and thermal conductivity, such as copper, are positioned around magnets 34 and 36, respectively, to reflect such thermal energy as may be radiated toward magnets 34 and 36, and to intercept such stray electrons as escape from the interaction region and impinge on cups 44 or 46 rather than the surfaces of magnets 34 or 36. Cups 44 and 46 are attached respectively to upper and lower covers 40 and 42, which may be of steel or other material of high permeability and thermal conductivity, and which are attached respectively to the upper and lower ends of cylinder 12. Cups 44 and 46 are of sufficient strength to hold magnets 34 and 36 tightly in place against covers 40 and 42 and have spaces 33 for gases in magnets 34 and 36 to escape during evacuation and bake out of the magnetron.

Since cylinder 12 and covers 40 and 42 are of high permeability material, a low reluctance magnetic path is formed therethrough and a major portion of the magnetic flux produced by the magnets 34 and 36 and passing through the electron interaction sapce between the tips of the anode members 14 and cathode 18 returns through anode cylinder 12 and covers 40 and 42. As a result, an interaction space flux density of, for example 1,500 to 2,000 gauss may be achieved with the relatively small rare earth permanent magnets, which being positioned inside a magnet return path structure produce extremely low stray magnetic fields outside the magnetron. Retaining cups 44 and 46 are preferably attached to covers 40 and 42 by means, such as spot welding, in regions spaced from the magnets 34 and 36, for example as at points 48 and 50, to avoid overheating magnets 34 and 36. It should be understood that the size, shape, and spacing of the magnets 34 and 36 may be adjusted to produce any desired intensity of magnetic field in the interaction space and that such intensity may be tapered in the region of the end shields to interact with stray electrons moving axially of the cathode.

Figure 3:
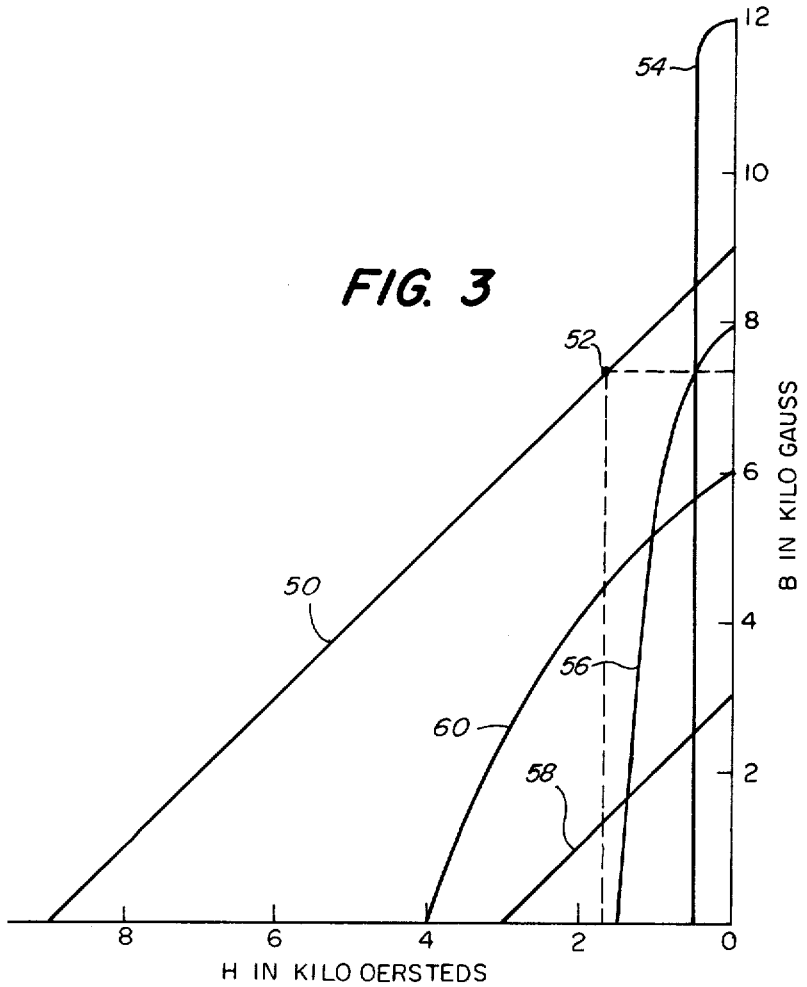
FIG. 3 illustrates a diagram of the characteristics of some permanent magnets including rare earth types useful in this invention.

Referring now to FIG. 3, there is shown a graph of the second quadrant hysterisis characteristics of various magnetic materials in which magnetizing force H in oersted and the flux density B in gauss. Curve 50 shows a rare earth cobalt such as $SmCo_5$ which is preferably formed of grains of $SmCo_5$ the majority of which have a size less than that which will support two domains hereafter referred to as single domain grains of $SmCo_5$. Such grains are preferably bonded together by materials which may include samarium oxide or other samarium cobalt compounds which prevent grain growth. Further description of such materials may be found in an aforementioned copending patent application, Ser. No. 416,700. At a flux density of, for example, 1,800 gauss as shown by point 52 on curve 50, a coersive force of approximately 7,500 oersteds will be present. Thus since the primary reluctance is in the interaction space between the magnets such as a gap can be on the order of five times the total axial distance through the magnets 34 and 36. It should thus be noted that such magnet material could in fact be utilized without a magnetic return path by utilizing a greater weight of magnet material. However, since the anode cylinder 12 and the magnet support covers 40 and 42 are preferably of materials having a large strength to weight ratio such as steel, whose inner surfaces are preferably plated with high conductivity material such as copper for a thickness of, for example, one mil it becomes economically advantageous to use these members as a magnetic flux return path. The substantial improvement of rare earth magnets over permanent magnets of alnico 5, alnico 8, ferrite, and platinum cobalt is shown by curves 54, 56, 58, and 60 respectively. At 1,800 gauss, alnico 5, as shown by curve 54, has a coersive force of less than 500 oersteds so that the total magnet length must be four to five times the air gap distance thereby substantially increasing the total path length of the alnico magnets as well as requiring a substantially additional weight. Ferrite, alnico 8, and platinum cobalt similarly required larger magnets, best of the group being platinum cobalt which is extremely expensive and, hence, economically impractical.

It should be clearly understood that $SmCo_5$ is shown by way of example only and other rare earth cobalts such as cerium cobalt could be used for the magnet material. By maintaining the material of the rare earth magnets 34 and 36 below 250° C., the tube can be operated for thousands of hours without sufficient shift in the characteristics of the magnets 34 and 36 to substantially affect the efficiency of the magnetron. In addition, after assembly of the tube, it may be heated to 400°–450° C. or even 500° C. during evacuation and bake out of the interior of the tube.

During operation, microwave energy generated by the magnetron is extracted from the resonant anode structure 14 by an output probe 62 connected to the upper edge of one of the anode members 14 and extending through an aperture 64 in upper cover 40 and upwardly through a metal cylinder 66 coaxial with the axis of the tube to pinch off seal tubulation 68 through which the tube is evacuated. Tubulation 68 is attached to cylinder 66 through a ceramic cylinder 70 to provide a vacuum seal, in which tubulation 68 is insulated from cylinder 66, and to provide an output aperture through which microwave energy is radiated by probe 62 to a microwave energy load such as a microwave oven. Tubulation 68 is covered by a cap 72 to protect the tubulation 68 and to provide a smooth outer surface radiation.

In order to prevent moding of the magnetron, straps 82 alternately connect the upper and lower edges of the inner ends of anode member 14 in accordance with well-known practice. If desired, end shields 30 and 32 may have grooves 84 therein to suppress axial mode oscillations during tube warm-up in accordance with the teaching of my copending application Ser. No. 781,288, filed Dec. 16, 1976.

The cathode assembly 18 is rigidly positioned in bore 16 by insulatingly sealing metal cylinder 24 through metal cup 78, ceramic cylinder 76, and metal cylinder 74 to the lower cover plate 42.

While the magnets retaining cups 44 and 46 are illustrated herein with apertures 33 to expose the magnets to the vacuum within the magnetron, if desired, the magnets 34 and 36 may be encapsulated between cups 44 and 46 and covers 40 and 42 respectively.

DESCRIPTION OF AN ALTERNATE EMBODIMENT

Figure 4:
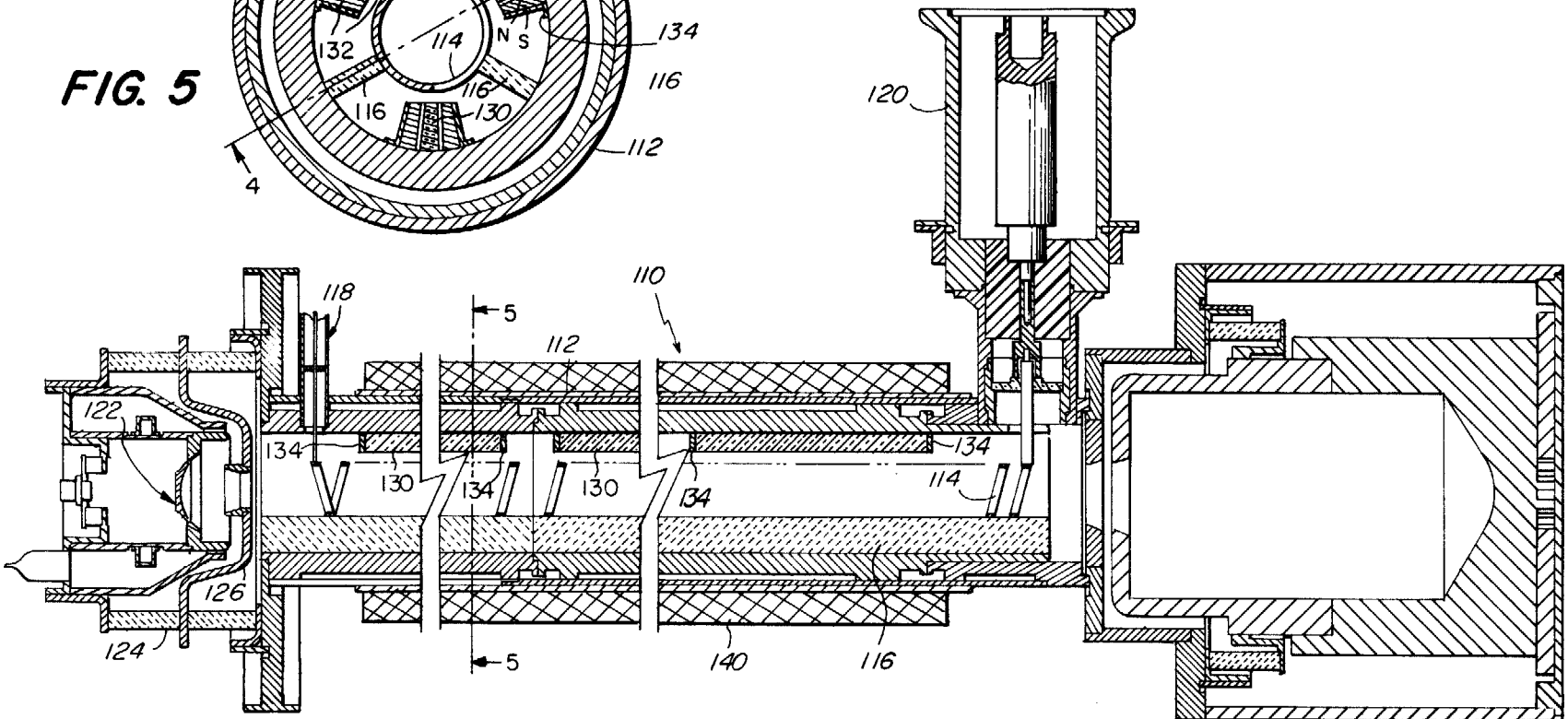
FIG. 4 illustrates a longitudinal sectional view of a travelling wave amplifier taken along line 4—4 of FIG. 5, and illustrating an alternate embodiment of the invention.
Figure 5:
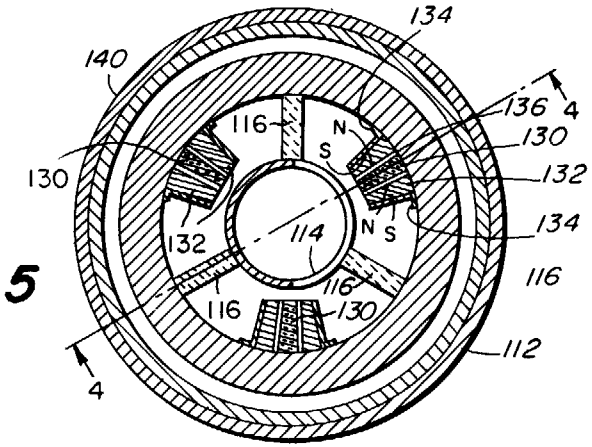
FIG. 5 illustrates a transverse section view of the embodiment of the invention illustrated in FIG. 4 taken along line 5—5 of FIG. 4.

Referring now to FIGS. 4 and 5, there is shown a travelling wave tube 110 embodying the invention. Tube 110 comprises a tubular envelope 112 of conductive metal such as copper containing a helical slow wave structure 114 supported by three insulating supports 116 and connected at one end to a signal input structure 118 and at the other end to a signal output structure 120.

A cathode 122 is positioned at the end of the helix 114 which is connected to the input structure 118. Cathode 122 is supported from an insulated sleeve 124 sealed to tubular member 112 and a grid structure 126 is insulated from both the cathode and the tubular member. Cathode 122 is heated by a heater 128 sealed through an insulating seal supported by sleeve 124. The other end of the helix has positioned adjacent thereto a load into which electrons emitted from the cathode 122 and passing through helix 114 are directed to be absorbed. Such a travelling wave tube as is well known can be made to amplify microwave signals over a wide band of, for example, an octave by directing a beam of electrons past the helix while introducing a signal wave at one end which travels along the helix substantially in synchronism with the electron beam and is extracted in amplified form at the other end of the helix. However, reflections from the output end of the helix to the input, due for example to mismatched signal input and output loads, can be re-reflected from the output to the input to cause the device to oscillate or produce undesirable amplification characteristics. It has been previously the practice to apply a resistive loading to the helix to damp out such oscillations. Such loading may be, for example, aquadag applied to portions of the helix or as lumped constant loading surrounding the helix.

In accordance with this invention, ferrite structures are positioned outside the helix in fringing microwave fields with unidirectional magnetic fields applied thereto by rare earth permanent magnets positioned inside the vacuum envelope to produce magnetic field components in a circumferential direction about the helix. Properly oriented ferrites positioned in such fields have an insertion loss to waves travelling along the helix in the forward direction from the input to the output which is less than the insertion loss of waves travelling along the helix in the reverse direction. As a result, less power is absorbed from the amplified wave moving in the forward direction than would otherwise be necessary if an isotropic loss medium were used and less heating thereby generated.

In accordance with this invention, there is shown in FIG. 5 a plurality of ferrite slabs 130 positioned in the spaces within the tubular member 112 between the support structures 116. Such ferrite slabs 130 are positioned between permanent magnet slabs 132 of a rare earth cobalt in accordance with this invention and the outer surfaces of permanent magnet 132 are covered by metal supports 134 which is welded to the inner surface of tubular member 112. Metal supports 134, in accordance with this invention, are preferably of material having high thermal conductivity such as copper and consists of a tab 136 extending substantially radially inwardly. The magnetic members 132 and ferrite 130 are slightly tapered so that they are retained adjacent the surface of tubular member 112. While as shown here, magnets 132 are positioned on either side of ferrite 130 and magnetically poled in the same direction to produce the circumferential magnetic field component, any desired configuration of magnet could be used.

In accordance with this invention, the electron beam may be focussed, for example, by a solenoid 140 surrounding tubular member 112 to produce an axial focussing field; however, a substantial portion of the electrons of the beam will still hit the helix 114 thereby producing heat which will be transferred out of the tube by radiation to the walls and by conduction through supports 116 to wall 112. The thermal energy impinging on the magnets 132 raises the surface temperature thereof but in accordance with this invention it has been discovered that such surface temperature can, in a vacuum, be raised to as high as 250° C. for extended periods of tube operation without observable magnetic field deterioration.

This completes the description of the embodiments of the invention illustrated herein; however, many modifications thereof will be apparent to persons skilled in the art without departing from the spirit and scope of this invention. For example, an axial permanent magnet of rare earth cobalt could be used in the travelling wave tube envelope in place of the external solenoid in the embodiments of FIGS. 4 and 5, the transverse magnetic field device of FIGS. 1 and 2 could be an amplitron or other cross field device and the principles of this invention could be applied to tubes other than the microwave oscillators and amplifiers disclosed herein. Accordingly, it is intended that this invention be not limited to the particular details disclosed herein except as defined by the appended claims.

What is claimed is:

1. A microwave tube comprising:

an evacuated envelope containing an anode structure having a plurality of resonators formed therein and surrounding a central bore containing a cathode; and means for producing a magnetic field transverse to the direction of motion of electrons from said cathode to said anode comprising permanent magnets supported wholly within the vacuum in said envelope adjacent the ends of said cathode;

said magnets being shielded from electrons emanating from said cathode; and said cathode having end shields with annular grooves providing substantially field free regions adjacent the ends of said cathode.

2. The microwave tube in accordance with claim 1 wherein said permanent magnets are comprised predominantly of sintered grains of cobalt compound having an average size less than that at which multiple domains will form in each grain during operation of said tube.

3. The microwave tube in accordance with claim 1 wherein the magnetic field produced by said permanent magnets in said bore has a flux density in the range between 1,000 and 3,000 gauss.

4. A microwave tube in accordance with claim 1 wherein said frequency responsive structure comprises reentrant anode electrically insulated from said cathode.

5. A microwave tube in accordance with claim 4 wherein said magnets are at anode potential and produce a magnetic field substantially coaxial with said cathode.

* * * * *